US009661936B2

(12) United States Patent
Lin et al.

(10) Patent No.: US 9,661,936 B2
(45) Date of Patent: May 30, 2017

(54) MULTI-USE CONVERTIBLE FRAME FOR A BABY CARRIER

(71) Applicant: LERADO (ZHONG SHAN) INDUSTRIAL CO., LTD., Zhong Shan, Guang Dong Province (CN)

(72) Inventors: Ping-Ching Lin, Zhongli (TW); Chia-Ming Shen, Kaohsiung (TW)

(73) Assignee: Dorel Juvenile (Zhongshan) Product Co., Ltd., Guang Dong (CN)

( * ) Notice: Subject to any disclaimer, the term of this patent is extended or adjusted under 35 U.S.C. 154(b) by 145 days.

(21) Appl. No.: 14/489,978

(22) Filed: Sep. 18, 2014

(65) Prior Publication Data

US 2015/0082539 A1 Mar. 26, 2015

(30) Foreign Application Priority Data

Sep. 26, 2013 (CN) ..... 2013 1 0442859
Sep. 26, 2013 (CN) ..... 2013 2 0596326 U

(51) Int. Cl.

| | |
|---|---|
| ***A47D 11/00*** | (2006.01) |
| ***A47D 9/00*** | (2006.01) |
| ***A47D 1/08*** | (2006.01) |
| ***A47D 1/00*** | (2006.01) |
| ***A47D 13/10*** | (2006.01) |

(52) U.S. Cl.
CPC ..... *A47D 11/005* (2013.01); *A47D 1/002* (2013.01); *A47D 1/08* (2013.01); *A47D 9/00* (2013.01); *A47D 13/102* (2013.01)

(58) Field of Classification Search
CPC ..... A47D 11/00
USPC ..... 5/101, 105, 108; 297/311, 344.26
See application file for complete search history.

(56) References Cited

U.S. PATENT DOCUMENTS 3,053,568 A * 9/1962 Miller ..... A61G 5/006 297/344.24

* cited by examiner

*Primary Examiner* — Fredrick Conley
(74) *Attorney, Agent, or Firm* — Muncy, Geissler, Olds & Lowe, P.C.

(57) ABSTRACT

A multi-use convertible frame for a baby carrier includes a base frame, a swivel mount, a support unit and a positioning mechanism. The support unit can be swiveled about ninety degrees from a first direction to a second direction, and vice versa. The support unit is leaned with an angle suitable for providing a chair mode in the first direction, and kept in a substantially horizontal position for providing a bassinet mode in the second direction. The base frame may be formed with a curved underside and rotatably mounted with two stoppers at the both ends thereof for converting the chair mode into a rocking chair mode and converting the bassinet mode into rocking bassinet mode.

15 Claims, 11 Drawing Sheets

MULTI-USE CONVERTIBLE FRAME FOR A BABY CARRIER

BACKGROUND OF THE INVENTION

Field of the Invention

The present invention is related to a frame of a baby carrier, especially to a baby carrier frame which can be converted from a chair mode into a bassinet mode, and vice versa.

Description of the Related Art

A new born baby or infant whose spine is weak for not yet being completely developed. At this stage, the parents should not let the new born baby or infant to sit on chair for a long time; to this regard, the best choice for the parents is to buy a bassinet, and perfectly to buy a rocking bassinet for smooth them by a gentle rocking to help them easy to fall into a happiness sleeping. However, when the new born baby or infant has grown for more months and been developed the ability of sitting and crawling, their sleeping time will become more shorter than before, and then the parent is needed to add a baby seat at home as well as to buy a rocking chair for such a grown family member.

Once the infant has been grown to be an elder baby, the aforementioned bassinet, rocking bassinet shall become some of troublesome obstacles at home and finally become useless garbage to throwaway. This way shall waste the precious earth material resource but people have no choice to avoid that happen again and again.

SUMMARY OF THE INVENTION

To avoid the aforementioned waste of the precious earth material resource, the present invention provides a multi-use convertible frame for a baby carrier that includes a base frame, a swivel mount, a support unit and a positioning mechanism.

The base frame is formed to be a lower portion of the convertible frame for contacting with the floor surface and support the support unit through the swivel mount. Specifically, the swivel mount is mounted on top of the base frame, and the support unit is swivelably connected to the swivel mount and can be locked in either a first direction or a second direction. In one embodiment, the support unit is leaned rearward with an angle for providing a chair mode in the first direction, and keeps in a substantially horizontal position for providing a bassinet mode in the second direction. In this embodiment, the support unit can be swiveled about ninety degrees from the first direction to the second direction, and vice versa.

The positioning mechanism is operatively mounted between the swivel mount and the support unit for releasably locking the support unit in either the first direction or the second direction for changing the modes of bassinet and chair.

In one embodiment, the base frame is formed with a curved underside for contacting and rocking on the floor, and two stoppers are lockably and rotatably mounted to both the front end and the rear end of the base frame respectively. In this embodiment, the base frame can be converted into a standing mode by locking the two stoppers in a position abutted on the floor at the same time, and converted to a rocking mode by unlocking and rotating the two stoppers away from the floor thereby converting the chair mode into a rocking chair mode and converting the bassinet mode into rocking bassinet mode.

The support rack according to the present invention may be used to stretch a facing cover thereon for supporting and accommodating an occupant in a fashion of either a bed or chair. Specifically, the support rack may include a front-upper frame, a rear-upper frame, a seat frame and a backrest frame. The rear-upper frame and the seat frame both are pivotally connected to a rotatable part of the connecting mounts, and the front-upper frame and the backrest frame are fixedly connected to a non-rotatable portion of the connecting mounts.

The linking rod is pivoted between the seat frame and the swivel mount. In this embodiment, the linking rod is used to turn the rear-upper frame and the seat frame in an angle from a substantially horizontal position when the support unit is swiveled to the first direction for converting the support unit into the chair mode, and turn the rear-upper frame and the seat frame back to the substantially horizontal position when the support unit is swiveled to the second direction thereby converting the support unit into the bassinet mode, and vice versa.

The positioning mechanism may include a release actuator operatively mounted on the support unit for associating with a latch member 41 by a linking element. Specifically, the release actuator is biased by a resilient element in a biased direction and can be driven by a user's hand to move against the biased direction so as to drive the latch member away from the swivel mount to unlock the support unit form either the first direction or the second direction.

According to the present invention, the release actuator may either be mounted on the front end of the seat frame or the front-upper frame for easy access to the user. The linking element may be embodied as a flexible part threaded through the seat frame (or front-upper frame) and associating between the latch member and the release actuator.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
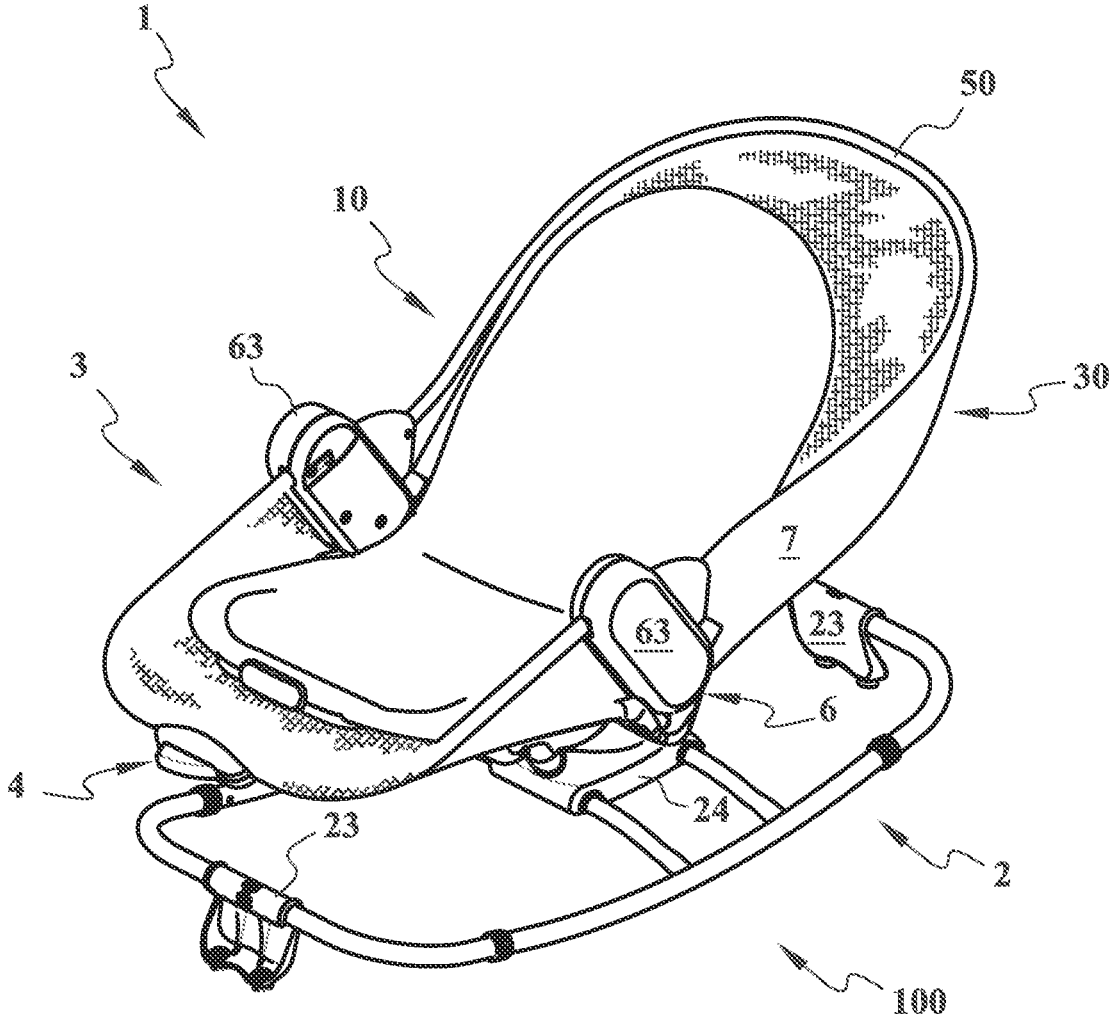
FIG. 1 is a schematic perspective view showing an embodiment of the multi-use convertible frame according to the present invention, provided with a facing cover and converted into a chair mode automatically by swiveling to a first direction.
Figure 2:
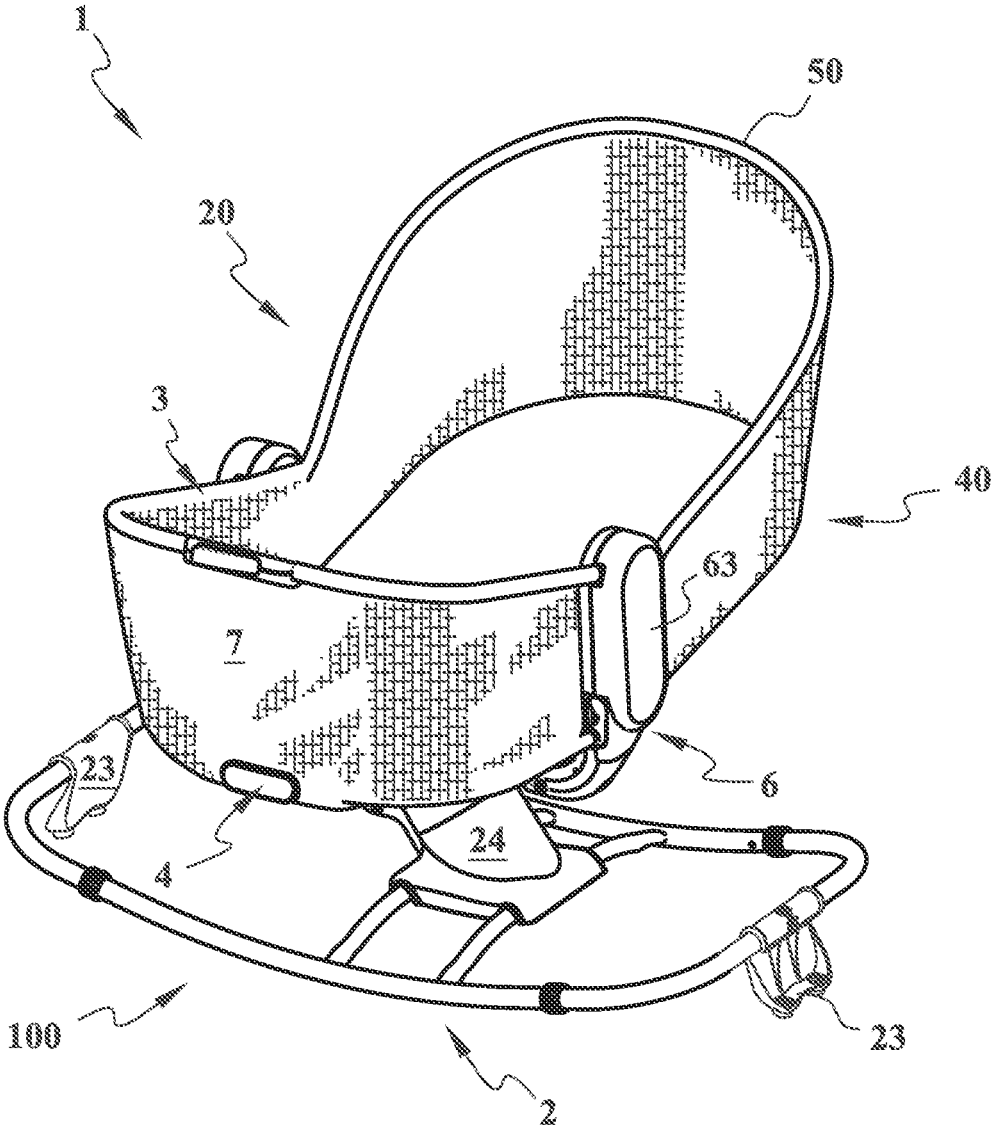
FIG. 2 is a schematic perspective view showing the multi-use convertible frame for a baby carrier of FIG. 1, provided with a facing cover and converted into a bassinet mode automatically by swiveling to a second direction.

Referring to FIGS. 1 and 2, an embodiment of the multi-use convertible frame 1 for a baby carrier according to the present invention includes a base frame 2, a swivel mount 24, a support unit 3 and a positioning mechanism 4.

Figure 11:
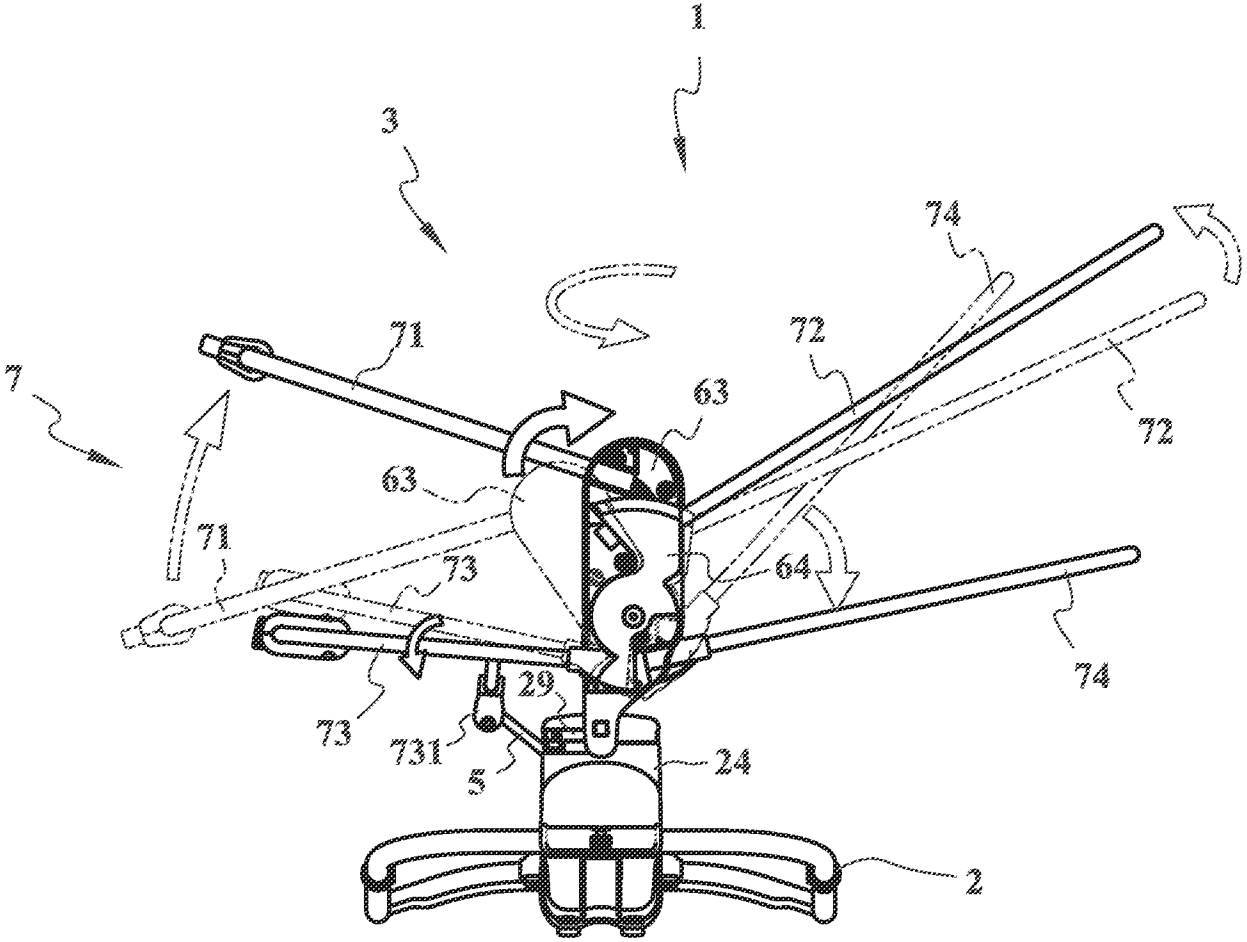
FIG. 11 is a schematic side view illustrating the conversion of the modes of the multi-use convertible frame according to the present invention that merely by swiveling the support unit between the first and second direction.

In this embodiment, the base frame 2 is formed a lower portion of the convertible frame 1 for contacting with the floor surface and supporting the support unit 3 through the swivel mount 24. In other words, the swivel mount 24 is mounted on top of the base frame 2, and the support unit 3 is swivelably connected to the swivel mount 24 and can be locked in either a first direction 30 or a second direction 40. In one embodiment as best shown in FIG. 11, the swivel mount 24 is leaned forward with an angle θ, and the support unit 3 is leaned for providing a chair mode 10 in the first direction 30, and keeps in a substantially horizontal position for providing a bassinet mode 20 in the second direction 40.

The support unit 3 can be swiveled about ninety degrees from the first direction 30 to the second direction 40, and vice versa. The positioning mechanism 4 is operatively mounted between the swivel mount 24 and the support unit 3 for releasably locking the support unit 3 in the first direction 30 and the second direction 40.

Figure 3:
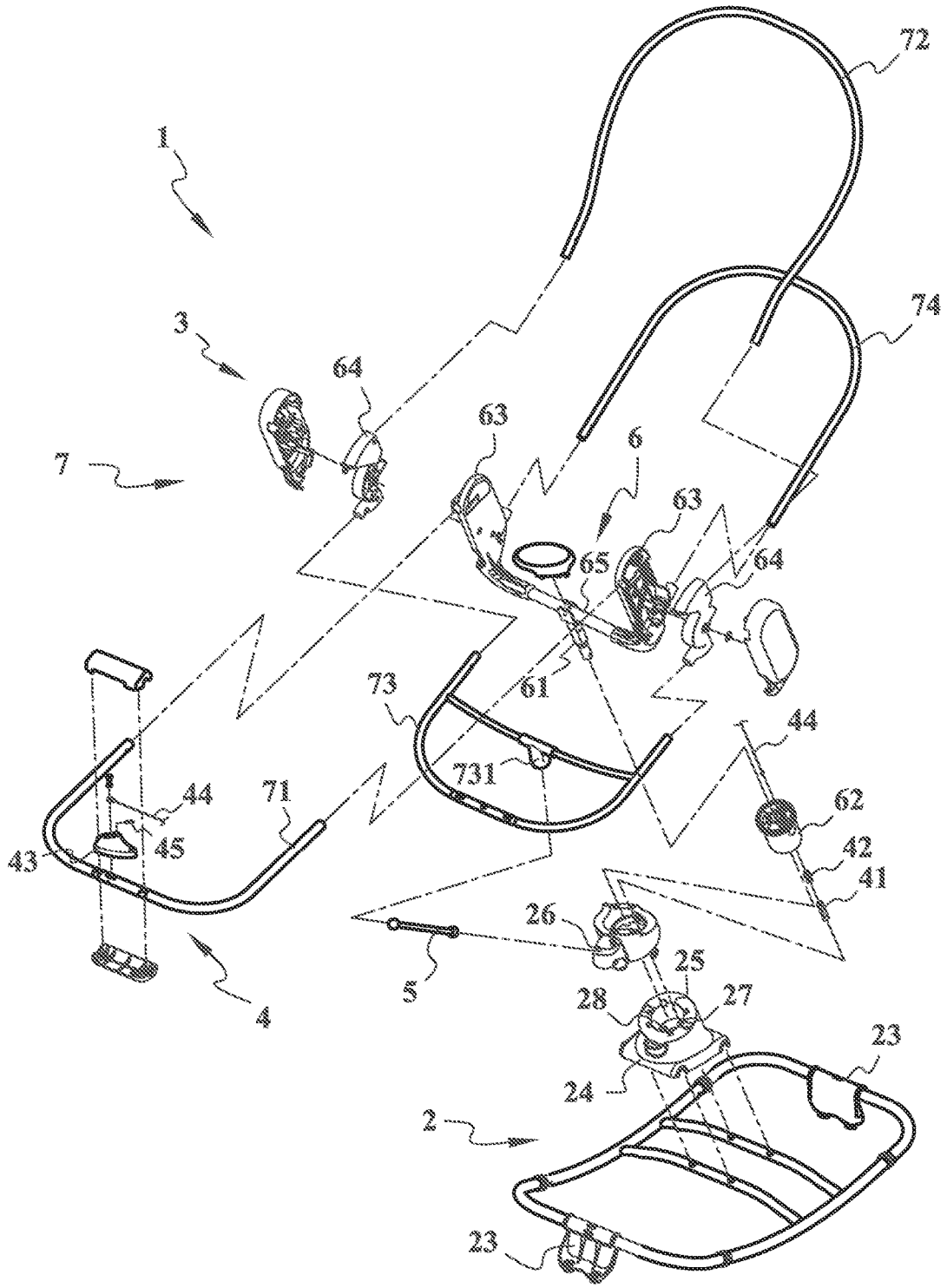
FIG. 3 is an exploded view of the multi-use convertible frame of FIG. 1.
Figure 4:
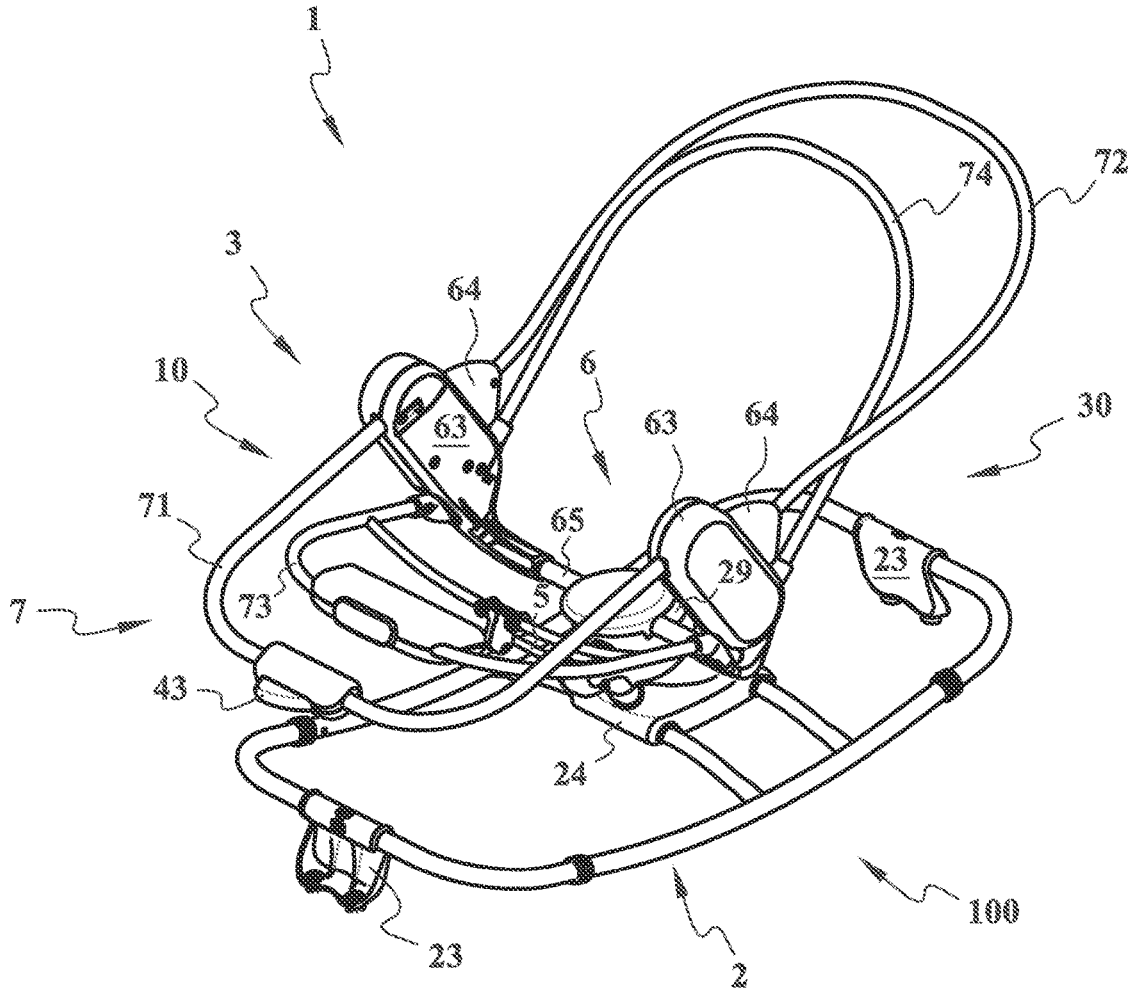
FIG. 4 is a schematic perspective view showing the multi-use convertible frame of FIG. 1 locked in the first direction and converted into the chair mode (the facing cover being removed to more clearly show the structure of the multi-use convertible frame in this mode).
Figure 9:
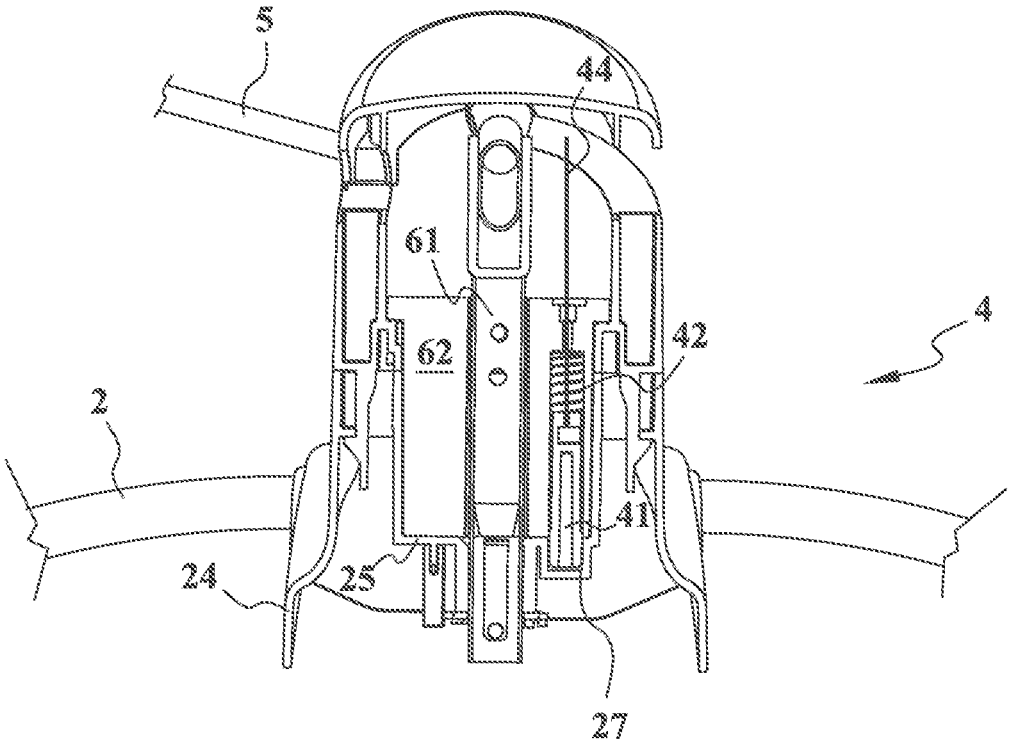
FIG. 9 is a cross-sectional view showing a latch member of the positioning mechanism according to the present invention being engaged with a first indented portion for locking a support unit in a first direction.
Figure 10:
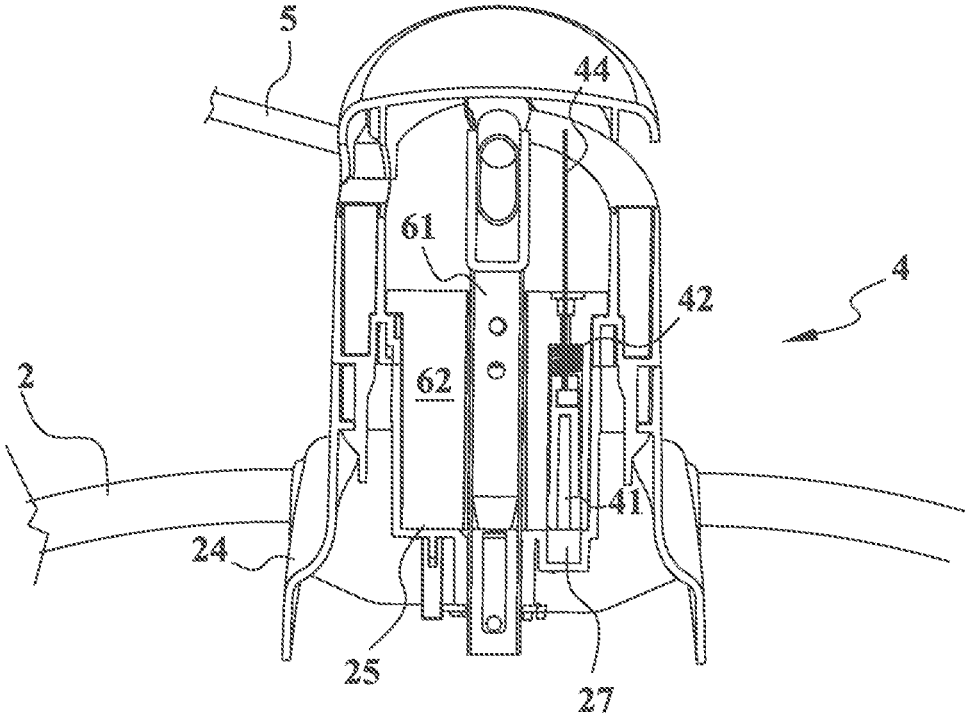
FIG. 10 is a cross-sectional view showing the latch member of FIG. 9 being disengaged from the first indented portion thereby unlocking the support unit from the first direction.

Referring to FIGS. 3, 9, and 10, the swivel mount 24 is preferably provided with an axial hole 25 that formed with a first indented portion 27 for locking the support unit 3 in the first direction 30 for providing the chair mode 10, and a second indented portion 28 for locking the support unit 3 in the second direction 40 for providing the bassinet mode 20.

In one embodiment as best shown in FIGS. 4, 6 to 8 and 11, the base frame 2 may also be formed with a curved underside for contacting and rocking on the floor, and two stoppers 23 are lockably and rotatably mounted to both the front end and the rear end of the base frame 2 respectively. In this embodiment, the base frame 2 can be converted into a standing mode 100 by locking the two stoppers 23 in a position abutted on the floor at the same time, and converted to a rocking mode 200 by unlocking and rotating the two stoppers 23 away from the floor thereby converting the chair mode 10 into a rocking chair mode and converting the bassinet mode 20 into rocking bassinet mode.

Referring again to FIGS. 3, 9, and 10, the swivel mount 24 is preferably provided with a horizontal guiding slot 29, and the support unit 3 is equipped with a rotatable frame 6, a support rack 7 and a linking rod 5.

In this embodiment, the rotatable frame 6 is pivoted to the swivel mount 24 and has a pair of connecting mounts 63 connected to a side extension arm 65. The side extension arm 65 has a shaft 61 extending downward for swivelably connecting to the swivel mount 24 and one end guided in the horizontal guiding slot 29 so as to guide the rotatable frame 6 to perform rotations on a substantial horizontal plane (not shown).

Referring to FIGS. 1 and 2, the support rack 7 may stretch a facing cover 50 thereon for supporting and accommodating an occupant in a fashion of either a bed or chair. Specifically, the support rack 7 may include a front-upper frame 71, a rear-upper frame 72, a seat frame 73 and a backrest frame 74. The rear-upper frame 72 and the seat frame 73 both are pivotally connected to the connecting mounts 63, and the front-upper frame 71 and the backrest frame 74 are fixedly connected to the connecting mounts 63.

Figure 5:
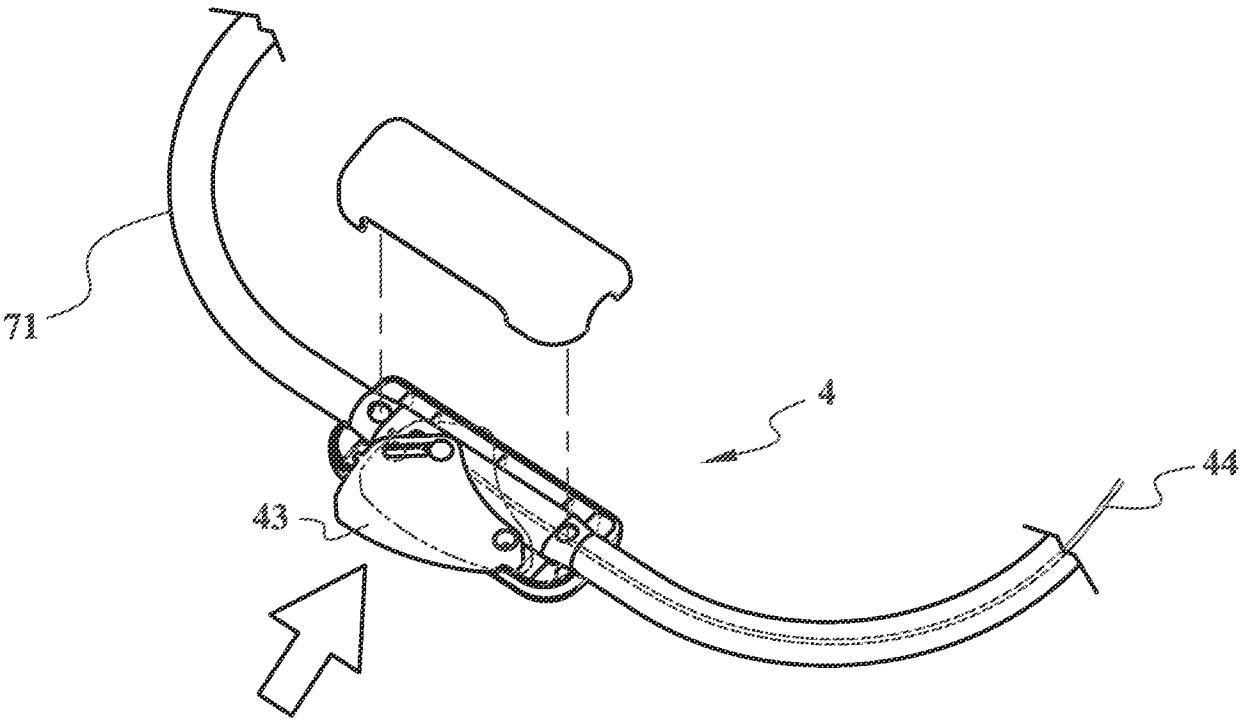
FIG. 5 is a schematic perspective view illustrating the operation of a positioning mechanism of the multi-use convertible frame according to the present invention.
Figure 6:
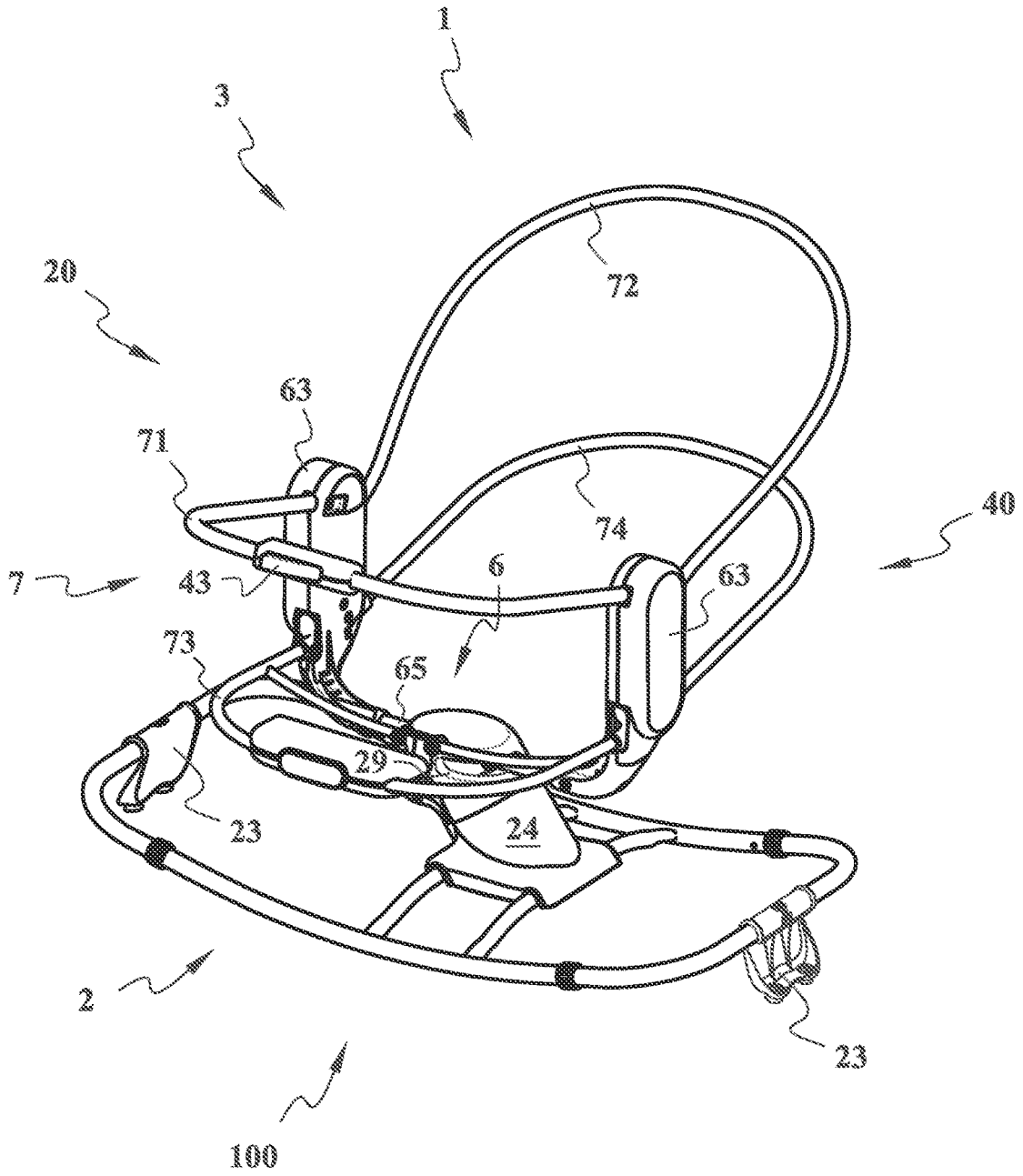
FIG. 6 is a schematic perspective view showing the multi-use convertible frame according to the present invention being locked in the second direction and converted into the bassinet mode (the facing cover being removed to more clearly show the structure of the multi-use convertible frame in this mode).
Figure 7:
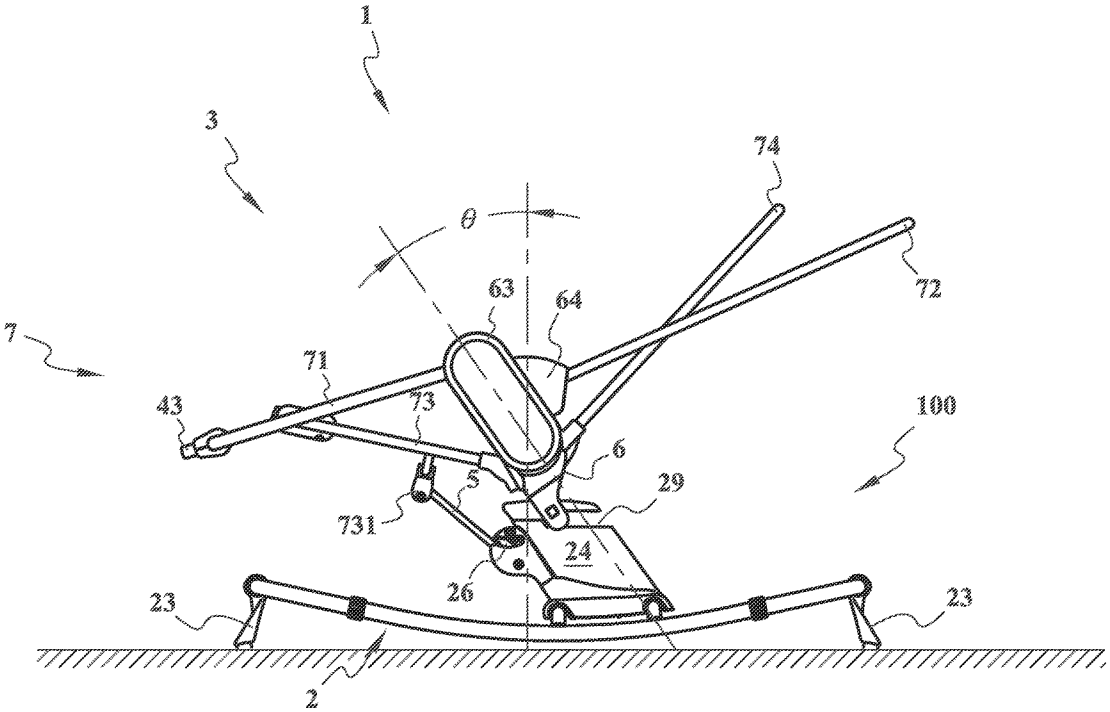
FIG. 7 is a schematic side view showing the multi-use convertible frame according to the present invention being locked in the first direction and converted into the chair mode (the facing cover being removed to more clearly show the seat frame and the rear-upper frame being rotated by a lining rod rearward in an angle from a substantially horizontal position).
Figure 8:
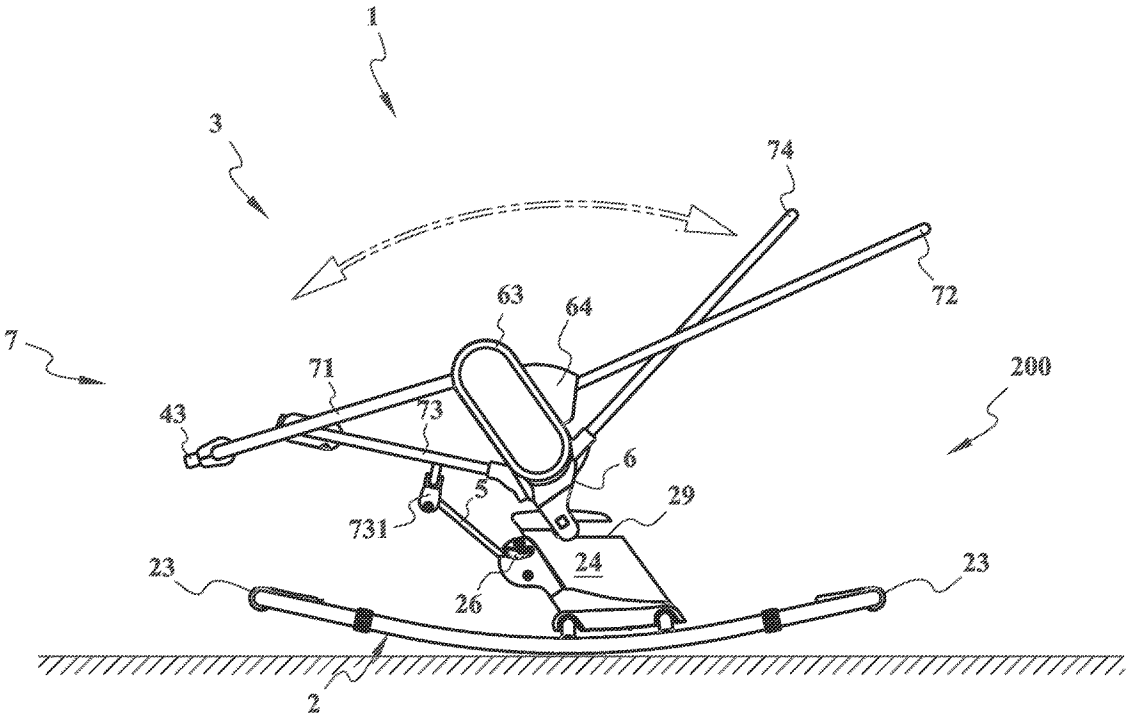
FIG. 8 is a schematic side view showing the multi-use convertible frame according to the present invention being converted from a standing mode to a rocking mode (the facing cover being removed to more clearly show the multi-use convertible frame in this mode).

Referring to FIGS. 3 and 5, the linking rod 5 is pivoted between the seat frame 73 and the swivel mount 24. In this embodiment, the linking rod 5 is used to turn the rear-upper frame 72 and the seat frame 73 in an angle from a substantially horizontal position (not shown) when the support unit 3 is swiveled to the first direction 30 for converting the support unit 3 into the chair mode 10, and turn the rear-upper frame 72 and the seat frame 73 back to the substantially horizontal position when the support unit 3 is swiveled to the second direction 40 thereby converting the support unit 3 into the bassinet mode 20, and vice versa.

Preferably, the linking rod 5 may be formed with two ball heads on the both ends thereof, and the swivel mount 24 and the seat frame 73 each is provided with a universal joint mount 731 for coupling with the two ball heads thereby permitting the linking rod 5 to rotate in all directions as needed in converting the support unit 3 into the chair mode 10 and the bassinet mode 20.

In this embodiment, the swivel mount 24 may further be formed with a guiding slot 26 for guiding the linking rod 5 by swiveling the rotatable frame 6. When the rotatable frame 6 is swiveled to the first direction 30, the guiding slot 26 shall guide the linking rod 5 to an angle that turns the rear-upper frame 72 and the seat frame 73 to a rearward inclined position for converting the support unit 3 into the chair mode 10, and when the rotatable frame 6 is swiveled to the second direction 40, the guiding slot 26 shall guide the linking rod 5 to another angle that turns the rear-upper frame 72 and the seat frame 73 back to the substantially horizontal position thereby converting the support unit 3 into the bassinet mode 20.

As best shown in FIGS. 3 and 9 to 10, the pair of connecting mounts 63 each may include a pivotal connector 64 for fixedly connecting the rear-upper frame 72 and the seat frame 73 so as to keep the rear-upper frame 72 to rotate integrally with the seat frame 73 to a rearward inclined position and a substantially horizontal position.

Preferably, the swivel mount 24 may further include an axle bush 62 for connecting the shaft 61 on its top portion. The axle bush 62 of this embodiment is swivelably mounted on the swivel mount 24, and the positioning mechanism 4 comprises a latch member 41 and a release actuator 43.

The latch member 41 is retractably mounted in the axle bush 62 and biased by a resilient member 42 for releasably engaging with the swivel mount 24 thereby locking the support unit 3 in the first direction 30 and the second direction 40. Specifically, the latch member 41 of this embodiment is use to engage with the first indented portion 27 for locking the support unit 3 in the first direction 30, and engage with the second indented portion 28 for locking the support unit 3 in the second direction 40.

Referring to FIGS. 3 and 5 again, the release actuator 43 may be operatively mounted on the support unit 3 for associating with the latch member 41 by a linking element 44. Specifically, the release actuator 43 is biased by a resilient element 45 in a biased direction and can be forced by the user's hand to move against the biased direction so as to drive the latch member 41 away from the swivel mount 24 so as to unlock the support unit 3 form the first direction 30 and the second direction 40.

In one alternative embodiment, the release actuator 43 is operatively mounted on the front end of the seat frame 73 for easy access to the user; in this embodiment the linking element 44 may be a flexible part threaded through the seat frame 73 and associating between the latch member 41 and the release actuator 43.

In another embodiment, the release actuator 43 may also be operatively mounted on the front-upper frame 71 (as this embodiment is a very simple change and easy understand to an ordinary skilled people, not shown in the drawings) for easy access to some taller users; in this alternative embodiment the linking element 44 is a flexible part threaded through the front-upper frame 71 and associating between the latch member 41 and the release actuator 43.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A multi-use convertible frame for a baby carrier, including:

a base frame, for contact with a floor surface;

a swivel mount mounted on the base frame;

a support unit swivelably connected to the swivel mount and being lockable in a first direction and a second direction; wherein the support unit is leaned for providing a chair mode in the first direction, and keeps in a substantially horizontal position for providing a bassinet mode in the second direction; and a positioning mechanism, operatively mounted between the swivel mount and the support unit for releasably locking the support unit in the first direction and the second direction, wherein the base frame has a curved underside for rocking on the floor, and two stoppers lockably and rotatably mounted to both the front end and the rear end of the base frame respectively;

wherein the base frame is converted into a standing mode by locking the two stoppers to a position abutted on the floor at the same time, and converted to a rocking mode by unlocking and rotating the two stoppers away from contacting the floor thereby converting the chair mode into a rocking chair mode and converting the bassinet mode into rocking bassinet mode.

2. A multi-use convertible frame for a baby carrier, including:

a base frame, for contact with a floor surface;

a swivel mount mounted on the base frame;

a support unit swivelably connected to the swivel mount and being lockable in a first direction and a second direction; wherein the support unit is leaned for providing a chair mode in the first direction, and keeps in a substantially horizontal position for providing a bassinet mode in the second direction; and a positioning mechanism, operatively mounted between the swivel mount and the support unit for releasably locking the support unit in the first direction and the second direction, wherein the swivel mount has an axial hole formed with a first indented portion for locking the support unit in the first direction for providing the chair mode, and a second indented portion for locking the support unit in the second direction for providing the bassinet mode.

3. A multi-use convertible frame for a baby carrier, including:

a base frame, for contact with a floor surface;

a swivel mount mounted on the base frame;

a support unit swivelably connected to the swivel mount and being lockable in a first direction and a second direction; wherein the support unit is leaned for providing a chair mode in the first direction, and keeps in a substantially horizontal position for providing a bassinet mode in the second direction; and a positioning mechanism, operatively mounted between the swivel mount and the support unit for releasably locking the support unit in the first direction and the second direction, wherein the swivel mount is leaned forward with an angle.

4. The multi-use convertible frame for a baby carrier according to claim 3, wherein the support unit is unlockable from the first direction to swivel about ninety degrees to be locked in the second direction, and vice versa.

5. The multi-use convertible frame for a baby carrier according to claim 3, wherein the swivel mount has a horizontal guiding slot, and the support unit including:

a rotatable frame, pivoted to the swivel mount and having a pair of connecting mounts connected to a side extension arm; wherein the side extension arm has a shaft extending downward for swivelably connecting to the swivel mount and has one end guided in the horizontal guiding slot so as to guide the rotatable frame to perform rotations on a substantial horizontal plane;

a support rack, including a front-upper frame, a rear-upper frame, a seat frame and a backrest frame; wherein the rear-upper frame and the seat frame are pivotally connected to the connecting mounts, and the front-upper frame and the backrest frame are fixedly connected to the connecting mounts; and a linking rod pivoted between the seat frame and the swivel mount; wherein the linking rod turns the rear-upper frame and the seat frame in an angle from a substantially horizontal position when the support unit is swiveled to the first direction thereby converting the support unit into the chair mode, and turns the rear-upper frame and the seat frame back to the substantially horizontal position when the support unit is swiveled to the second direction so as to convert the support unit into the bassinet mode.

6. The multi-use convertible frame for a baby carrier according to claim 5, wherein the linking rod is formed with two ball heads on both ends thereof, and the swivel mount and the seat frame each is provided with a universal joint mount for coupling with the two ball heads of the linking rod thereby permitting the linking rod to rotate in all directions as needed in converting the support unit into the chair mode and the bassinet mode.

7. The multi-use convertible frame for a baby carrier according to claim 5, wherein the swivel mount is formed with a guiding slot for guiding the linking rod by swiveling the rotatable frame; wherein when the rotatable frame is swiveled to the first direction, the guiding slot guides the linking rod to an angle that turns the rear-upper frame and the seat frame to a rearward inclined position for converting the support unit into the chair mode, and when the rotatable frame is swiveled to the second direction, the guiding slot guides the linking rod to another angle that turns the rear-upper frame and the seat frame back to the substantially horizontal position thereby converting the support unit into the bassinet mode.

8. The multi-use convertible frame for a baby carrier according to claim 5, wherein the pair of connecting mounts each includes a pivotal connector fixedly connected the rear-upper frame and the seat frame such that keeps the rear-upper frame to rotate integrally with the seat frame to a rearward inclined position and a substantially horizontal position.

9. The multi-use convertible frame for a baby carrier according to claim 5 further include an axle bush connected the shaft to the swivel mount, the axle bush being swivelably mounted on the swivel mount, and the positioning mechanism comprising:

a latch member retractably mounted in the axle bush and biased by a resilient member for releasably engaging with the swivel mount thereby locking the support unit in the first direction and the second direction; and a release actuator operatively mounted on the support unit for associating with the latch member by a linking element, wherein the release actuator is biased by a resilient element in a biased direction, and can be forced by hand to move against the biased direction so as to drive the latch member away from the swivel mount thereby unlocking the support unit form the first direction and the second direction.

10. The multi-use convertible frame for a baby carrier according to claim 9, wherein the swivel mount is formed with an axle bore; the axle bore has one side formed with a first indented portion for engaging with the latch member when the support unit is swiveled to the first direction, and a second indented portion for engaging with the latch member when the support unit is swiveled to the second direction.

11. The multi-use convertible frame for a baby carrier according to claim 9, wherein the linking element is a flexible part threaded through the seat frame and associating between the latch member and the release actuator.

12. The multi-use convertible frame for a baby carrier according to claim 9, wherein the swivel mount has a horizontal guiding slot, and the support unit including:

a rotatable frame, pivoted to the swivel mount and having a pair of connecting mounts connected to a side extension arm; wherein the side extension arm has a shaft extending downward for swivelably connecting to the swivel mount and has one end guided in the horizontal guiding slot so as to guide the rotatable frame to perform rotations on a substantially horizontal plane;

a support rack, including a front-upper frame, a rear-upper frame, a seat frame and a backrest frame; wherein the rear-upper frame and the seat frame are pivotally connected to the connecting mounts, the front-upper frame and the backrest frame are fixedly connected to the connecting mounts, and the release actuator is operatively mounted on a front end of the seat frame; and a linking rod pivoted between the seat frame and the swivel mount; wherein the linking rod turns the rear-upper frame and the seat frame in an angle from a horizontal position when the support unit is swiveled to the first direction thereby converting the support unit into the chair mode, and turns the rear-upper frame and the seat frame back to the horizontal position when the support unit is swiveled to the second direction so as to convert the support unit into the bassinet mode.

13. The multi-use convertible frame for a baby carrier according to claim 9, wherein the swivel mount has a horizontal guiding slot, and the support unit including:

a rotatable frame, pivoted to the swivel mount and having a pair of connecting mounts connected to a side extension arm; wherein the side extension arm has a shaft extending downward for swivelably connecting to the swivel mount and has one end guided in the horizontal guiding slot so as to guide the rotatable frame to perform rotations on a substantially horizontal plane;

a support rack, including a front-upper frame, a rear-upper frame, a seat frame and a backrest frame; wherein the rear-upper frame and the seat frame are pivotally connected to the connecting mounts, the front-upper frame and the backrest frame are fixedly connected to the connecting mounts, and the release actuator is operatively mounted on the front-upper frame; and a linking rod pivoted between the seat frame and the swivel mount; wherein the linking rod turns the rear-upper frame and the seat frame in an angle from a horizontal position when the support unit is swiveled to the first direction thereby converting the support unit into the chair mode, and turns the rear-upper frame and the seat frame back to the horizontal position when the support unit is swiveled to the second direction so as to convert the support unit into the bassinet mode.

14. The multi-use convertible frame for a baby carrier according to claim 13, wherein the linking element is a flexible part threaded through the front-upper frame and associating between the latch member and the release actuator.

15. The multi-use convertible frame for a baby carrier according to claim 5, wherein the support rack is stretched a facing cover for supporting and accommodating an occupant in use as a chair and a bed.

* * * * *